US011328604B2

(12) United States Patent
Ljung Aust et al.

(10) Patent No.: US 11,328,604 B2
(45) Date of Patent: May 10, 2022

(54) INDIVIDUAL ALERT SYSTEM AND METHOD

(71) Applicant: Volvo Car Corporation, Gothenburg (SE)

(72) Inventors: Mikael Ljung Aust, Västra Frölunda (SE); Jenny Strömberg, Gothenburg (SE); Magdalena Lindman, Alafors (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 16/829,051

(22) Filed: Mar. 25, 2020

(65) Prior Publication Data

US 2020/0320878 A1 Oct. 8, 2020

Related U.S. Application Data

(60) Provisional application No. 62/848,169, filed on May 15, 2019, provisional application No. 62/827,942, filed on Apr. 2, 2019.

(51) Int. Cl.
*G08G 1/16* (2006.01)

(52) U.S. Cl.
CPC ..... *G08G 1/166* (2013.01)

(58) Field of Classification Search
CPC ..... G08G 1/005; B60Q 9/008
USPC ..... 340/539.11
See application file for complete search history.

(56) References Cited

U.S. PATENT DOCUMENTS

2005/0073438 A1* 4/2005 Rodgers ..... G08G 1/161 340/944
2011/0090093 A1* 4/2011 Grimm ..... G08G 1/162 340/901
2013/0261887 A1* 10/2013 Raz ..... B60Q 5/00 701/36
2015/0109149 A1* 4/2015 Duncan ..... G02B 27/017 340/944
2016/0292997 A1* 10/2016 Milne ..... H04W 4/80
(Continued)

FOREIGN PATENT DOCUMENTS

CN 201509293 U 6/2010
CN 104015656 A 9/2014
(Continued)

*Primary Examiner* — Fabricio R Murillo Garcia
(74) *Attorney, Agent, or Firm* — Clements Bernard Walker; Christopher L. Bernard

(57) ABSTRACT

A pedestrian alert system and method that acts in two alternative manners: (1) an individual device is configured to "listen" for an audible alert (over ambient noise) or "look" for a visual alert issued by the driver of a vehicle, or the vehicle itself, in advance of an impending impact event and, upon detecting such audible or visual alert, issue a local alert to a pedestrian, cyclist, scooter rider, skateboarder, or other vulnerable road user wearing the individual device; and (2) upon the automated detection of an impending impact event by a vehicle, the vehicle is configured to automatically emit an audible and/or non-audible signal that is detected by the individual device associated with the pedestrian, cyclist, scooter rider, skateboarder, or other vulnerable road user and acted upon to locally alert the pedestrian, cyclist, scooter rider, skateboarder, or other vulnerable road user of the impending impact event.

18 Claims, 4 Drawing Sheets

(56) References Cited

U.S. PATENT DOCUMENTS

| | | | | |
|---|---|---|---|---|
| 2017/0072850 | A1* | 3/2017 | Curtis | G08G 1/168 |
| 2017/0213435 | A1* | 7/2017 | Barth | H04W 4/027 |
| 2018/0233048 | A1* | 8/2018 | Andersson | G01S 15/86 |
| 2019/0279503 | A1* | 9/2019 | Patel | G10L 25/51 |
| 2021/0006956 | A1* | 1/2021 | Chen | H04W 4/029 |

FOREIGN PATENT DOCUMENTS

| | | | |
|---|---|---|---|
| EP | 2846172 | A1 | 3/2015 |
| KR | 101478951 | B1 | 1/2015 |
| WO | 2011152794 | A1 | 12/2011 |
| WO | 2015120428 | A1 | 8/2015 |

* cited by examiner

INDIVIDUAL ALERT SYSTEM AND METHOD

CROSS-REFERENCE TO RELATED APPLICATIONS

The present disclosure claims the benefit of priority of U.S. Provisional Patent Application No. 62/827,942, filed on Apr. 2, 2019, and entitled "PEDESTRIAN ALERT SYSTEM AND METHOD," and U.S. Provisional Patent Application No. 62/848,169, filed on May 15, 2019, and entitled "PEDESTRIAN ALERT SYSTEM AND METHOD," the contents of both of which are incorporated in full by reference herein.

TECHNICAL FIELD

The present disclosure relates generally to the automotive and safety fields. More particularly, the present disclosure relates to an individual alert system and method in which the safety systems of a vehicle and an individual device work in cooperation to ensure the safety of an individual, such as a pedestrian, cyclist, scooter rider, skateboarder, pet, or other vulnerable road user, upon the occurrence of an impending impact event with the vehicle.

BACKGROUND

Various automotive manufacturers have developed enhanced collision-avoidance and mitigation technologies. These collision-avoidance and mitigation technologies typically utilize a combination of radar sensors, lidar sensors, and cameras to detect and automatically respond to an impending impact event between a vehicle and another vehicle, a pedestrian, a cyclist, a large animal, or a stationary object in the vehicle's path, day or night, in good-visibility or low-visibility conditions. This automatic response can include the issuance of a driver alert, controlled auto-braking, and/or controlled auto-steering, and is becoming more sophisticated each year, especially at low speeds The purpose of such enhanced collision-avoidance and mitigation systems is to assist a driver through an intuitive warning strategy and braking and/or steering support systems. If an impact event is imminent, the systems provide automatic braking and/or steering when the driver fails to respond to the impending impact event. The focus is on avoiding the impact event entirely or reducing the vehicle's speed as much as possible prior to the impact event to lessen its severity. Exemplary areas addressed include, but are not limited to:

- Oncoming vehicles, including motorcycles, scooters, and bicycles, when the driver turns left (or right in left-hand traffic). The system detects an impending impact event and brakes automatically in order to avoid the impact event or mitigate the severity of the impact event.
- Vehicles, including motorcycles and scooters, travelling in the same direction. The system is able to avoid an impact event if the relative speed difference between the two vehicles is up to 50 km/h (31 mph), for example. At higher speeds, the automatic braking helps to reduce the severity of the impact event.
- Cyclists crossing the path of the vehicle or suddenly swerving out in front it. Depending on the situation, the system is able to avoid an impact event if the relative speed difference is up to 45 km/h (28 mph), for example. At higher speeds, the automatic braking helps to reduce the severity of the impact event.

- Pedestrians walking and animals running out in front of the vehicle. The system is able to avoid an impact event at speeds up to 45 km/h (28 mph), for example. At higher speeds, the automatic braking helps to reduce the severity of the impact event.

Such systems are often based on a combined radar and camera unit integrated at the top of the windscreen, in front of the interior rear-view mirror of the vehicle. The latest technology upgrades include smarter and faster, high-sensitivity, megapixel-image cameras combined with advanced exposure control. This makes the detection and auto-braking technologies work effectively, even when driving in darkness.

The radar's task is to detect objects in front of the vehicle and to determine their position and movement, and the distance to them. The camera identifies what type of object it is. The technology continuously monitors the object—and a central control unit uses the radar and camera data to evaluate the risk of an impact event and to initiate the most efficient and effective countermeasure.

In an emergency situation, the driver receives an audible alert combined with a haptic warning in the form of a short braking pulse and/or steering shake and a light flashing on the lower part of the windscreen, for example. If the driver reacts to the warning and starts braking, the system is programmed to automatically 'fill in' with more braking power, if necessary. If the driver does not react at all, the auto-brake is activated. Full braking power is applied approximately 1.0 second before impact, for example.

Thus, most existing collision-avoidance and mitigation technologies are vehicle-based and do not address a reaction on the part of a pedestrian, cyclist, or other vulnerable road user, especially one wearing headphones, such as noise-canceling headphones, or the like, which are commonplace today. Some noise-canceling headphones have been developed that "listen" for a person's shouted name, a horn honk, a siren, etc. and, when "heard", the noise-canceling headphones cease to cancel noise, such that ambient noises can again be heard by the user. However, such noise-canceling headphones do little to ensure that the user is adequately alerted to an impending impact event by taking affirmative local alert actions, for example.

SUMMARY

The present disclosure provides an individual alert system and method that acts in two alternative manners: (1) an individual device is configured to "listen" for an audible alert (over ambient noise) or "look" for a visual alert issued by the driver of a vehicle, or the vehicle itself, in advance of an impending impact event and, upon detecting such audible or visual alert, issue a local alert to a pedestrian, cyclist, scooter rider, skateboarder, or other vulnerable road user wearing the individual device; and (2) upon the automated detection of an impending impact event by a vehicle, the vehicle is configured to automatically emit an audible and/or non-audible signal that is detected by the individual device associated with the pedestrian, cyclist, scooter rider, skateboarder, or other vulnerable road user and acted upon to locally alert the pedestrian, cyclist, scooter rider, skateboarder, or other vulnerable road user of the impending impact event. In the first case, the individual device may include headphones, noise-canceling headphones, a smart phone, a smart watch, a dedicated device, or a pet collar that utilizes a microphone and/or camera or other sensors and a software processing algorithm that are collectively operable for discriminating a horn honk, a siren blare, or the like over ambient noise based on frequency composition, decibel levels, and/or the like and/or "seeing" a visual alert and providing an audible, visual, and or haptic local alert to the user that is of sufficient intensity and duration to obtain the full attention of the user, ceasing noise cancellation at the same time, when applicable. Optionally, in the second case, the automatic vehicle signal is a non-audible ultra-high-frequency (UHF) signal above 18 kHz, for example, but it may also be accompanied by a vehicle horn alert, lights flashing, etc. (i.e., more conventional alerts). Such signal(s) are received by the individual device worn or held by the pedestrian, cyclist, scooter rider, skateboarder, or other vulnerable road user and the responsive local alert may be audible, visual, haptic, etc., again of sufficient intensity and duration to obtain the full attention of the user, ceasing noise cancellation at the same time, when applicable. Optionally, the local device may also trigger the local illumination of lights associated with the individual device, clothing worn by the user, a pet collar, or the like, making the user more visible to the driver.

Thus, the present disclosure, whether vehicle or individual device-initiated, finds particular applicability in vulnerable road users who may be deaf or blind to vehicular dangers around them using local audible, visual, and/or haptic alerts. For example, headphones, such as noise-canceling headphones, or a mobile device can be made to beep and vibrate (or flash) in advance of an impending impact event, causing the deaf or blind person to turn their attention immediately to their surrounding environment and take evasive actions.

In one exemplary embodiment, the present disclosure provides a device, including; a signal receiver operable for receiving a signal emitted by a vehicle; a signal processor in communication with the signal receiver and operable for identifying the signal as being associated with an impending impact event between the vehicle and a user associated with the device and issuing a local user alert signal; and a local user alert generator coupled to the signal processor and operable for delivering a local user alert to the user associated with the device, wherein the local user alert includes one or more of an audible alert, a visual alert, and a haptic alert. Optionally, the signal is an audible signal and the signal processor is operable for identifying the signal as being associated with the impending impact event based one or more of a frequency composition of the audible signal, a decibel level of the audible signal, and a duration of the audible signal. Alternatively, the signal is a non-audible signal. Alternatively, the signal is a visual signal and the signal processor is operable for identifying the signal as being associated with the impending impact event based one or more of a pattern of the visual signal, an intensity of the visual signal, and a duration of the visual signal. Optionally, the signal processor is further operable for alerting a pedestrian safety system of the vehicle to the impending impact event via a communications link of the device. Optionally, the signal processor is further operable for interrupting one or more of audio being broadcast by the device to the user, noise-cancellation being performed by the device, and imagery being broadcast by the device to the user such that the local user alert may be received by the user without distraction. The system may also include an illumination device coupled to the device operable for illuminating responsive to the local user alert signal. The device includes one of microphone-equipped headphones, sensor-equipped headphones, noise-canceling headphones, a mobile phone, a smart watch, a dedicated carry-able device, a dedicated wearable device, for example.

In another exemplary embodiment, the present disclosure provides an alert system, including: an individual detection system coupled to a vehicle and operable for detecting a vulnerable road user in proximity to the vehicle and an impending impact event; a signal generator coupled to the individual detection system and operable for, when the impending impact event is detected, emitting a signal; a signal receiver coupled to a device associated with the vulnerable road user and operable for receiving the signal emitted by the vehicle; a signal processor in communication with the signal receiver and operable for issuing a local user alert signal, responsive to receipt of the signal, and a local user alert generator coupled to the signal processor and operable for delivering a local user alert to the vulnerable road user, wherein the local user alert includes one or more of an audible alert, a visual alert, and a haptic alert.

In a further exemplary embodiment, the present disclosure provides a method, including: detecting an impending impact event at one or more of a vehicle and a device associated with a vulnerable road user in proximity to the vehicle; and, responsive to detecting the impending impact event, delivering a local user alert to the vulnerable road user at the device, wherein the local user alert includes one or more of an audible alert, a visual alert, and a haptic alert. When the impact event is detected at the vehicle, the method further includes sending a signal from the vehicle to the device to inform the device of the impending impact event. The signal includes one or more of an audible signal, a non-audible signal, and a visual signal. When the impact event is detected at the device, the method further includes sending a signal from the device to the vehicle to inform the vehicle of the impending impact event. Optionally, the method further includes, coincident with delivering the local user alert to the vulnerable road user at the device, illuminating an illumination device coupled to the device and associated with the vulnerable road user.

BRIEF DESCRIPTION OF THE DRAWINGS

The present disclosure is illustrated and described with reference to the various drawings, in which like reference numbers are used to denote like system components/method steps, as appropriate, and in which.

DESCRIPTION OF EMBODIMENTS

The present disclosure provides an individual alert system and method that acts in two alternative manners. (1) an individual device is configured to "listen" for an audible alert (over ambient noise) or "look" for a visual alert issued by the driver of a vehicle, or the vehicle itself, in advance of an impending impact event and, upon detecting such audible or visual alert, issue a local alert to a pedestrian, cyclist, scooter rider, skateboarder, or other vulnerable road user wearing the individual device; and (2) upon the automated detection of an impending impact event by a vehicle, the vehicle is configured to automatically emit an audible and/or non-audible signal that is detected by the individual device associated with the pedestrian, cyclist, scooter rider, skateboarder, or other vulnerable road user and acted upon to locally alert the pedestrian, cyclist, scooter rider, skateboarder, or other vulnerable road user of the impending impact event. In the first case, the individual device may include headphones, noise-canceling headphones, a smart phone, a smart watch, a dedicated device, or a pet collar that utilizes a microphone and/or camera or other sensors and a software processing algorithm that are collectively operable for discriminating a horn honk, a siren blare, or the like over ambient noise based on frequency composition, decibel levels, and/or the like and/or "seeing" a visual alert and providing an audible, visual, and or haptic local alert to the user that is of sufficient intensity and duration to obtain the full attention of the user, ceasing noise cancellation at the same time, when applicable. Optionally, in the second case, the automatic vehicle signal is a non-audible UHF signal above 18 kHz, for example, but it may also be accompanied by a vehicle horn alert, lights flashing, etc. (i.e., more conventional alerts). Such signal(s) are received by the individual device worn or held by the pedestrian, cyclist, scooter rider, skateboarder, or other vulnerable road user and the responsive local alert may be audible, visual, haptic, etc., again of sufficient intensity and duration to obtain the full attention of the user, ceasing noise cancellation at the same time, when applicable. Optionally, the local device may also trigger the local illumination of lights associated with the individual device, clothing worn by the user, a pet collar, or the like, making the user more visible to the driver.

Thus, the present disclosure, whether vehicle or individual device-initiated, finds particular applicability in vulnerable road users who may be deaf or blind to vehicular dangers around them using local audible, visual, and/or haptic alerts. For example, headphones, such as noise-canceling headphones, or a mobile device can be made to beep and vibrate (or flash) in advance of an impending impact event, causing the deaf or blind person to turn their attention immediately to their surrounding environment and take evasive actions.

Figure 1:
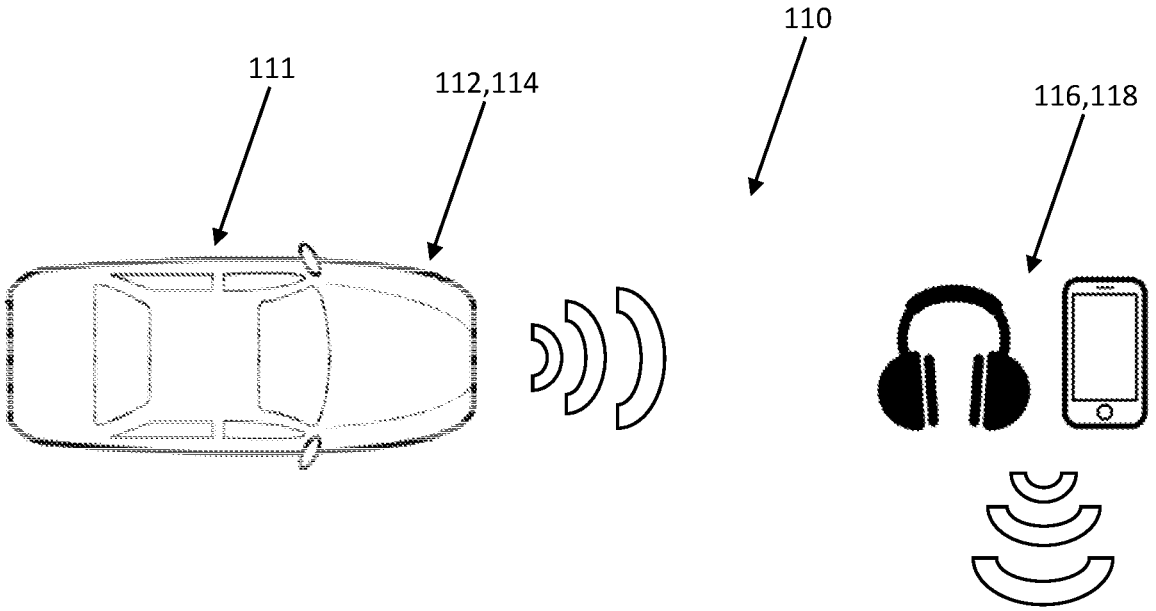
FIG. 1 is a schematic diagram illustrating one exemplary embodiment of the individual alert system of the present disclosure in general.

Referring now specifically to FIG. 1, in one exemplary embodiment, the individual alert system 110 includes a vehicle-based pedestrian detection system 112, well known to those of ordinary skill in the at. Such pedestrian detection system 112 typically includes one or more radar sensors, lidar sensors, and/or cameras mounted on the vehicle 111 and operable for sensing and/or capturing an image of a pedestrian, cyclist, scooter rider, skateboarder, animal, or other vulnerable road user in the vicinity of the vehicle 111. The pedestrian detection system 112 also typically includes one or more processors executing one or more algorithms, such as one or more artificial intelligence (AI) object recognition and tracking algorithms, operable for detecting, identifying, and tracking the pedestrian, cyclist, scooter rider, skateboarder, animal, or other vulnerable road user and one or more algorithms, such as one or more vehicle control algorithms, operable for alerting a driver to an impending impact event with the pedestrian, cyclist, scooter rider, skateboarder, animal, or other vulnerable road user and automatically braking and/or steering the vehicle 111 to avoid the impact event.

Here, the individual alert system 110 also includes a signal generator 114 coupled to the vehicle 111 that is operable for, in the event that an impact event with the pedestrian, cyclist, scooter rider, skateboarder, animal, or other vulnerable road user is imminent, sending a non-audible signal to the individual device 116, such as the microphone or sensor-equipped headphones or noise-canceling headphones worn by the pedestrian, cyclist, scooter rider, skateboarder, or other vulnerable road user, a mobile device carried by the pedestrian, cyclist, scooter rider, skateboarder, or other vulnerable road user, a smart watch worn by the pedestrian, cyclist, scooter rider, skateboarder, or other vulnerable road user, or another comparable device associated with the pedestrian, cyclist, scooter rider, skateboarder, or other vulnerable road user. This non-audible signal may be, for example, a UHF signal over 18 kHz. The headphones or other individual device 116 includes a signal receiver 118 operable for receiving the non-audible signal and generating one or more of an audible alert, a visual alert, and/or a haptic alert that is received and prompts evasive action by the pedestrian, cyclist, scooter rider, skateboarder, or other vulnerable road user. Thus, in accordance with the present disclosure, the vehicle-based pedestrian detection system 112 is extended and able to prompt an impact event-avoidance behavior on the part of the pedestrian, cyclist, scooter rider, skateboarder, or other vulnerable road user, even when the pedestrian, cyclist, scooter rider, skateboarder, or other vulnerable road user is inattentive, otherwise occupied, deaf, blind, etc. Preferably, this audible, visual, or haptic alert is noticed above background noise and distractions. It will be readily apparent to those of ordinary skill in the art that the non-audible signal can utilize any appropriate near-field signaling technology that is receivable above background noise and through other interferences. Alternatively, the non-audible signal can also be replaced or supplemented by an audible or visual signal, such as a horn honking or lights flashing, for example. This audible or visual signal can then be used to trigger the appropriate local alert.

In addition to the non-audible signal, the vehicle-based pedestrian detection system 112 can also cause the vehicle 111 to honk its horn, flash its lights, and emit other audible and visual alerts in the event of an impending impact event, further alerting the pedestrian, cyclist, scooter rider, skateboarder, or other vulnerable road user, as well as surrounding parties. Further, the individual device 116 can cause lights or the like to be illuminated, either on the individual device 116, on clothing worn by the user, on a pet collar worn by an animal, etc., making the vulnerable road user more visible to the driver in dark and/or low-visibility conditions.

It should be noted that the vehicle-based pedestrian detection system 112 can be a smart system, such that the non-audible signal is emitted only when the impending impact event is determined to be a pedestrian, cyclist, scooter rider, skateboarder, animal, or other vulnerable road user via camera image segmentation and annotation, for example, well known to those of ordinary skill in the art.

In an alternative exemplary embodiment, the individual alert system 110 is essentially wholly contained within the individual device 116 depicted, whether it is microphone or sensor-equipped headphones, noise-canceling headphones, a mobile phone, a smart watch, a dedicated alert device, a pet collar, etc. Here, the individual device 116 alone is operable for "listening" for an audible alert (over ambient noise) or "seeing" a visual alert issued by the driver of the vehicle 111, or the vehicle 111 itself, in advance of the impending impact event. In other words, the individual device 116 is operable for "listening" for a vehicle horn honk (and/or a siren blare, a scream, etc.) or "seeing" a vehicle's lights flashing. Upon detecting such audible or visual alert, the individual device 116 is operable for issuing a local alert to the pedestrian, cyclist, scooter rider, skateboarder, or other vulnerable road user carrying or wearing the individual device 116. Again, this local alert may be audible, visual, and/or haptic and is of sufficient intensity and duration to obtain the full attention of the user, ceasing noise cancellation at the same time, when applicable. Further, the individual device 116 can cause lights or the like to be illuminated, either on the individual device 116, on clothing worn by the user, on a pet collar worn by an animal, etc., making the vulnerable road user more visible to the driver in dark and/or low-visibility conditions.

Figure 2:
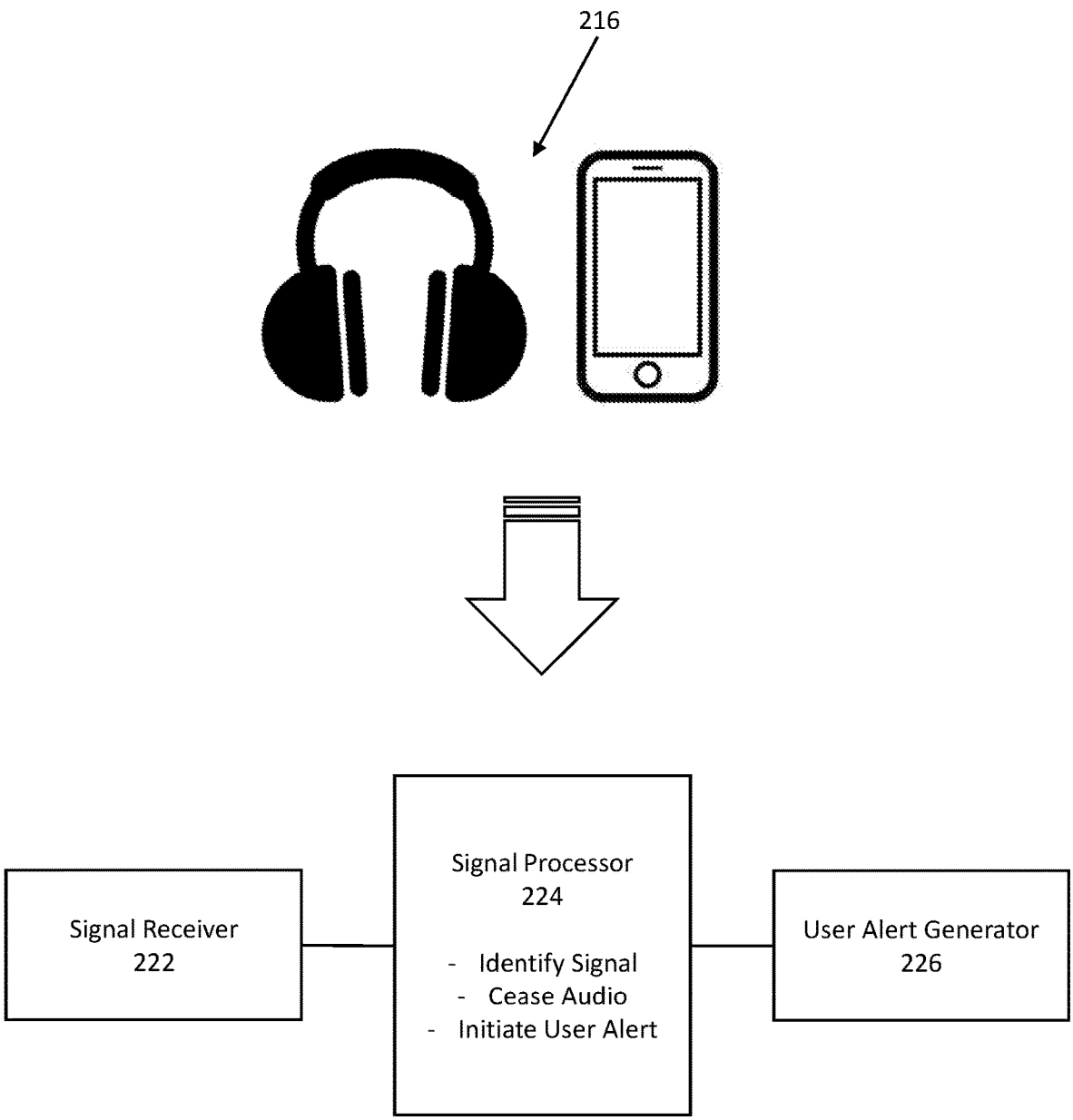
FIG. 2 is a schematic diagram illustrating one exemplary embodiment of the individual device-based pedestrian system of the present disclosure.

Referring now specifically to FIG. 2, in another exemplary embodiment, the individual device 216 may include a microphone and/or other sensor/receiver 222 and appropriate processing logic and software 224 for independently detecting an audible (or visual) signal emitted by the vehicle 111 (FIG. 1), such as a horn noise (or siren blare or light flash), and issuing the local alert (audible, visual, and/or haptic) to the pedestrian, cyclist, scooter rider, skateboarder, or other vulnerable road user using a user alert generator 226 associated with the individual device 216, in this case without the active involvement of the vehicle 111. It is preferable that the local alert be issued such that it interrupts or is delivered over any sounds, images, or sensory stimuli already being delivered by the individual device 216. In such cases, the individual device 216 may also be operable for emitting a signal to the vehicle 111 to then activate the vehicle's pedestrian detection systems and methods 112 (FIG. 1), if not already activated. Thus, in such cases, individual protection is handled initially by the individual device 116 responsive to a siren blare or scream being "heard", for example, before a nearby driver is aware of an impending impact event. Thus, in essence, both the individual device 116 and the vehicle 111 are "listening" and "looking" for potential threats, and making sure that the other is "paying attention" when such a potential threat is detected by either. Here, preferably, the individual device 116 utilizes a microphone or other sensor 222 and a software processing algorithm 224 that is operable for discriminating a horn honk, a siren blare, or the like over ambient noise based on frequency composition, decibel levels, and/or the like, for example, and providing an audible, visual, and/or haptic local alert to the user that is of sufficient intensity and duration to obtain the full attention of the user, ceasing noise cancellation at the same time, when applicable.

Figure 3:
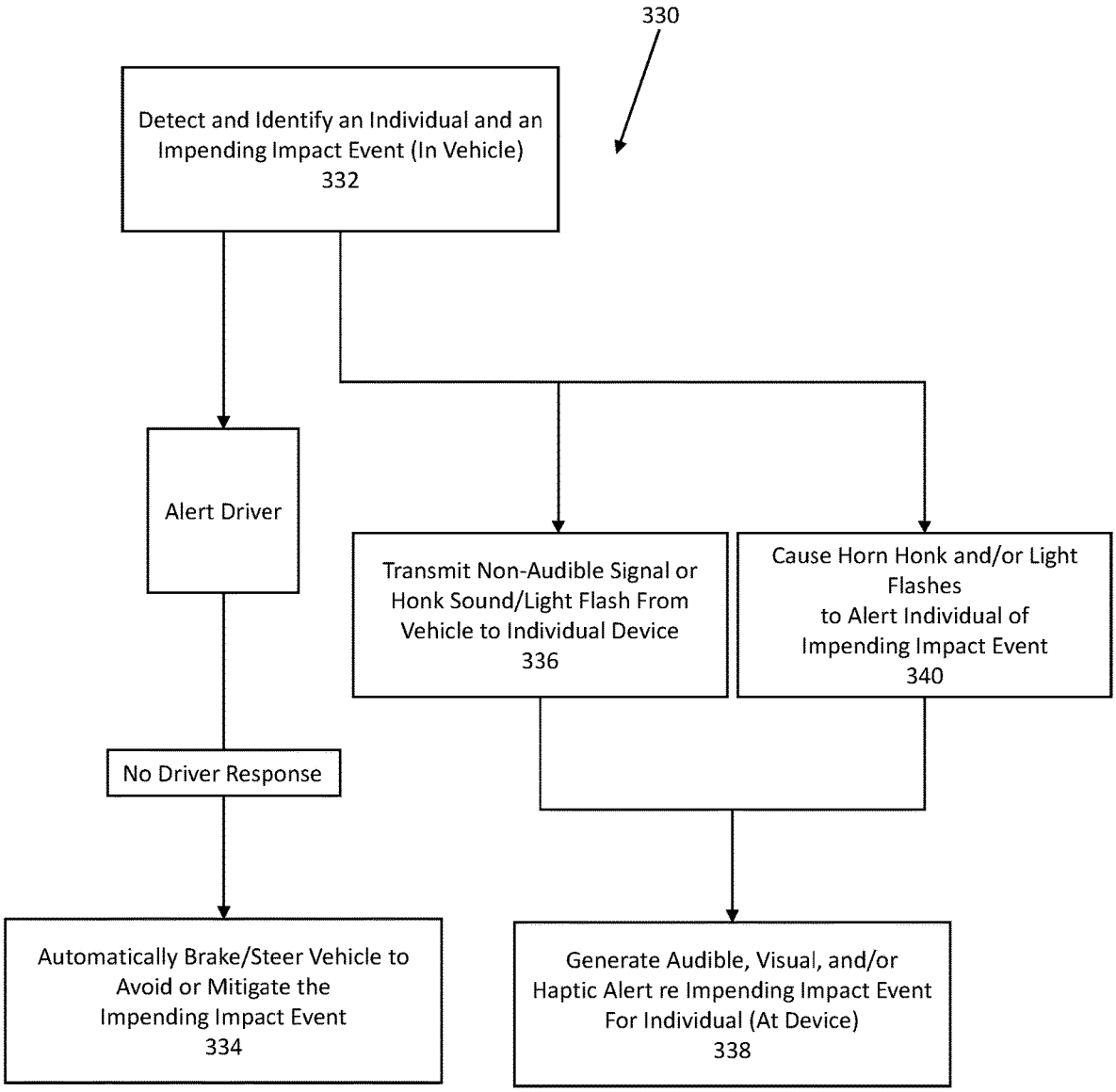
FIG. 3 is a flowchart illustrating one exemplary embodiment of the vehicle-based pedestrian alert method of the present disclosure.

Referring now specifically to FIG. 3, in a further exemplary embodiment, the individual alert method 330 includes providing a vehicle-based pedestrian detection system 112 (FIG. 1), well known to those of ordinary skill in the art. Again, such pedestrian detection system 112 typically includes one or more radar sensors, lidar sensors, and/or cameras mounted on the vehicle 111 (FIG. 1) and operable for sensing and/or capturing an image of a pedestrian, cyclist, or other vulnerable road user in the vicinity of the vehicle 111. The pedestrian detection system 112 also typically includes one or more processors executing one or more algorithms, such as one or more artificial intelligence (AI) object recognition algorithms, operable for detecting and identifying the pedestrian, cyclist, or other vulnerable road user and one or more algorithms, such as one or more vehicle control algorithms, operable for alerting a driver to an impending impact event with the pedestrian, cyclist, or other vulnerable road user and automatically braking and/or steering the vehicle 111 to avoid the impending impact event after a null or inadequate driver response is received. Thus, the individual alert method 330 includes detecting and identifying the pedestrian, cyclist, or other vulnerable road user 332 and, in response, automatically braking and/or steering the vehicle 111 to avoid the impending impact event 324, as is conventional.

Here, the individual alert method 330 also includes providing a signal generator 114 (FIG. 1) coupled to the vehicle 11 that is operable for, in the event that an impact event with the pedestrian, cyclist, or other vulnerable road user is imminent, sending a non-audible signal to the individual device 116 (FIG. 1) carried or worn by the pedestrian, cyclist, or other vulnerable road user, such as the headphones, mobile device, smart watch, or the like, or another comparable device associated with the pedestrian, cyclist, or other vulnerable road user 336. This non-audible signal may again be, for example, a UHF signal over 18 kHz. An audible or visual signal can likewise be sent as part of or instead of this step 336. The individual device 116 includes a signal receiver 118 (FIG. 1) operable for receiving the non-audible (or audible) signal and generating one or more of an audible alert, a visual alert, and/or a haptic alert that is received and prompts evasive action by the pedestrian, cyclist, or other vulnerable road user 338. Thus, in accordance with the present disclosure, the vehicle-based individual detection method 330 is able to prompt an impact event-avoidance behavior on the part of the pedestrian, cyclist, or other vulnerable road user, even when the pedestrian, cyclist, or other vulnerable road user is inattentive, otherwise occupied, deaf, blind, etc. Preferably, this audible, visual, and/or haptic alert is noticed above background noise and distractions. It will again be readily apparent to those of ordinary skill in the art that the non-audible signal can utilize any appropriate near-field signaling technology that is receivable above background noise and through other interferences.

In addition to the non-audible signal, the vehicle-based individual detection method 330 can also cause the vehicle 111 to honk its horn, flash its lights, and emit other audible and visual alerts in the event of an impending impact event, further alerting the pedestrian, cyclist, or other vulnerable road user, as well as surrounding parties 340.

It should again be noted that the vehicle-based pedestrian detection system 112 can be a smart system, such that the non-audible signal is emitted only when the impending impact event is determined to be a pedestrian, cyclist, or other vulnerable road user via camera image segmentation and annotation, for example, well known to those of ordinary skill in the art. Further, it should be noted that vehicle horns are arranged in pairs to produce an interval consisting of two notes when sounded together, with some exceptions with only one horn. The use of two differing frequencies with their beat frequencies and missing fundamentals is more perceptible than the use of two horns of identical frequency. Typical frequencies of a pair of horns of this design are 500 Hz and 405-420 Hz (a major third). The detection algorithm utilized herein may work either by frequency domain detection or correlation techniques in combination with level threshold detection, for example.

Figure 4:
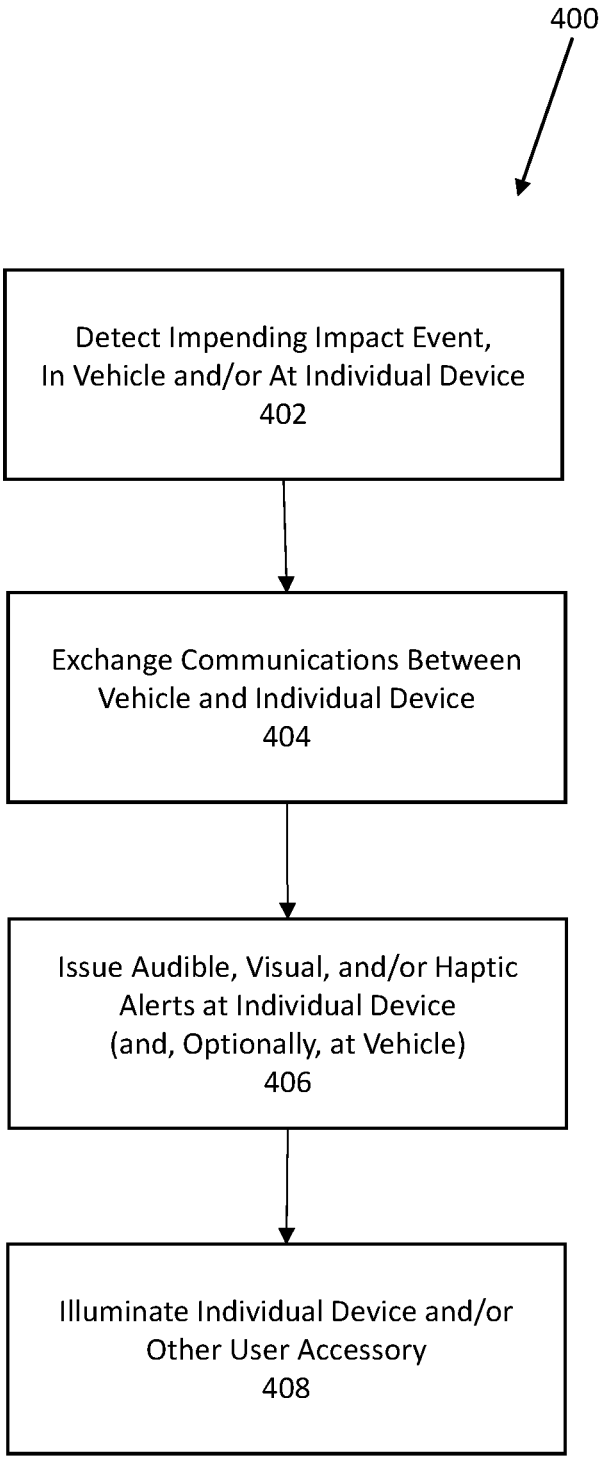
FIG. 4 is a flowchart illustrating another exemplary embodiment of the vehicle-based pedestrian alert method of the present disclosure.

Referring now specifically to FIG. 4, in a still further exemplary embodiment, an alternate individual protection method 400 of the present disclosure includes detecting an impending impact event, either on an in vehicle basis or at an individual device 116 (FIG. 1) 402. Information regarding the impending impact event is then exchanged between the vehicle and the individual device 116 404, especially when the impending impact event is first detected by the vehicle 111 (FIG. 1). Information can also be transmitted from the individual device 116 to the vehicle 111 in the event that it is desirable to trigger the pedestrian safety system 112

(FIG. 1) of the vehicle 111. Subsequently, audible, visual, and/or haptic alerts are responsively issued at the individual device 116 406, and possibly also at the vehicle 111, to alert the pedestrian, cyclist, or other vulnerable road user to the imminent nature of the impending impact event, especially if that individual is deaf, blind, or distracted. Finally, in this exemplary embodiment, the individual device 116 triggers the illumination of itself, a light associated with a device carried by or an article of clothing carried by the individual, a pet collar worn by an animal to which individual device is attached, etc. This illumination aides the driver and others in visualizing and avoiding the individual, especially under poor-visibility conditions.

It is to be recognized that, depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) a tangible computer-readable storage medium that is non-transitory or (2) a communication medium, such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can include random-access memory (RAM), read-only memory (ROM), electrically erasable-programmable read-only memory (EEPROM), compact disc read-only memory (CD-ROM) or other optical disc storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared (IR), radio frequency (RF), and microwave, then the coaxial cable, fiber optic cable, twisted pair, DSL, or wireless technologies, such as IR, RF, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable gate arrays (FPGAs), complex programmable logic devices (CPLDs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Thus, the present disclosure provides an individual alert system and method that acts in two alternative manners: (1) an individual device is configured to "listen" for an audible alert (over ambient noise) or "look" for a visual alert issued by the driver of a vehicle, or the vehicle itself, in advance of an impending impact event and, upon detecting such audible or visual alert, issue a local alert to a pedestrian, cyclist, scooter rider, skateboarder, or other vulnerable road user wearing the individual device; and (2) upon the automated detection of an impending impact event by a vehicle, the vehicle is configured to automatically emit an audible and/or non-audible signal that is detected by the individual device associated with the pedestrian, cyclist, scooter rider, skateboarder, or other vulnerable road user and acted upon to locally alert the pedestrian, cyclist, scooter rider, skateboarder, or other vulnerable road user of the impending impact event. In the first case, the individual device may include headphones, noise-canceling headphones, a smart phone, a smart watch, a dedicated device, or a pet collar that utilizes a microphone and/or camera or other sensors and a software processing algorithm that are collectively operable for discriminating a horn honk, a siren blare, or the like over ambient noise based on frequency composition, decibel levels, and/or the like and/or "seeing" a visual alert and providing an audible, visual, and or haptic local alert to the user that is of sufficient intensity and duration to obtain the full attention of the user, ceasing noise cancellation at the same time, when applicable. Optionally, in the second case, the automatic vehicle signal is a non-audible UHF signal above 18 kHz, for example, but it may also be accompanied by a vehicle horn alert, lights flashing, etc. (i.e., more conventional alerts). Such signal(s) are received by the individual device worn or held by the pedestrian, cyclist, scooter rider, skateboarder, or other vulnerable road user and the responsive local alert may be audible, visual, haptic, etc., again of sufficient intensity and duration to obtain the full attention of the user, ceasing noise cancellation at the same time, when applicable. Optionally, the local device may also trigger the local illumination of lights associated with the individual device, clothing worn by the user, a pet collar, or the like, making the user more visible to the driver.

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following non-limiting claims for all purposes.

What is claimed is:

1. A device, comprising;

signal receiver operable for receiving a signal chosen from at least one of an audible signal and a visual signal emitted by a vehicle responsive to the vehicle or an operator of the vehicle detecting an impending impact event between the vehicle and a user associated with the device;

a signal processor in communication with the signal receiver and operable for identifying the signal as being associated with the impending impact event and issuing a local user alert signal; and a local user alert generator coupled to the signal processor and operable for delivering a local user alert, based on the local user alert signal, to the user associated with the device, wherein the local user alert comprises one or more of an audible alert, a visual alert, and a haptic alert, wherein for the audible signal, the signal processor is operable for distinguishing the audible signal over ambient noise, and for the visual signal, the signal processor is operable for identifying the visual signal as being associated with the impending impact event based on one or more of a pattern of one or more lights emitted from the vehicle, an intensity of the one or more lights emitted from the vehicle, and a duration of the one or more lights emitted from the vehicle, wherein the local user alert is only generated when it is determined that the user associated with the device is one of a pedestrian, cyclist, or other vulnerable road user.

2. The device of claim 1, wherein the signal is the audible signal and the signal processor is operable for identifying the signal as being associated with the impending impact event based one or more of a frequency composition of the audible signal, a decibel level of the audible signal, and a duration of the audible signal.

3. The device of claim 1, wherein the signal further is a non-audible signal.

4. The device of claim 1, wherein the signal processor is further operable for alerting a pedestrian safety system of the vehicle to the impending impact event via a communications link of the device.

5. The device of claim 1, wherein the signal processor is further operable for interrupting one or more of audio being broadcast by the device to the user, noise-cancellation being performed by the device, and imagery being broadcast by the device to the user such that the local user alert may be received by the user without distraction.

6. The device of claim 1, further comprising an illumination device coupled to the device operable for illuminating responsive to the local user alert signal.

7. The device of claim 1, wherein the device comprises one of microphone-equipped headphones, sensor-equipped headphones, noise-canceling headphones, a mobile phone, a smart watch, a dedicated carry-able device, a dedicated wearable device, and a pet collar.

8. An alert system, comprising:

an individual detection system coupled to a vehicle and operable for detecting a vulnerable road user in proximity to the vehicle and an impending impact event, wherein the individual detection system is operable for segmenting the vulnerable road user from an image, identifying the vulnerable road user, and tracking the vulnerable road user to detect the impending impact event;

a signal generator coupled to the individual detection system and operable for, when the impending impact event is detected by the individual detection system, emitting a signal external to the vehicle, the signal being one of an audible signal and a visual signal;

a signal receiver coupled to a device associated with the vulnerable road user and operable for receiving the signal emitted by the vehicle;

a signal processor in communication with the signal receiver and operable for issuing a local user alert signal responsive to receipt of the signal; and a local user alert generator coupled to the signal processor and operable for delivering a local user alert, based on the local user alert signal, to the vulnerable road user, wherein the local user alert comprises one or more of an audible alert, a visual alert, and a haptic alert, wherein for the audible signal, the signal processor is operable for distinguishing the audible signal over ambient noise, and for the visual signal, the signal processor is operable for identifying the visual signal as being associated with the impending impact event based on one or more of a pattern of one or more lights emitted from the vehicle, an intensity of the one or more lights emitted from the vehicle, and a duration of the one or more lights emitted from the vehicle, wherein the local user alert is only generated when it is determined that the user associated with the device is one of a pedestrian, cyclist, or other vulnerable road user.

9. The alert system of claim 8, wherein the signal is an audible signal and the signal processor is operable for identifying the signal as being associated with the impending impact event based one or more of a frequency composition of the audible signal, a decibel level of the audible signal, and a duration of the audible signal.

10. The alert system of claim 8, wherein the signal is a non-audible signal.

11. The alert system of claim 8, wherein the signal processor is further operable for interrupting one or more of audio being broadcast by the device to the vulnerable road user, noise-cancellation being performed by the device, and imagery being broadcast by the device to the vulnerable road user such that the local user alert may be received by the vulnerable road user without distraction.

12. The alert system of claim 8, wherein the device comprises one of microphone-equipped headphones, sensor-equipped headphones, noise-canceling headphones, a mobile phone, a smart watch, a dedicated carry-able device, a dedicated wearable device, and a pet collar.

13. A method, comprising:

detecting an impending impact event at one or more of a vehicle and a device associated with a vulnerable road user in proximity to the vehicle; and responsive to detecting the impending impact event, delivering a local user alert, based on a local alert signal, to the vulnerable road user at the device, wherein the local user alert comprises one or more of an audible alert, a visual alert, and a haptic alert;

wherein detecting the impending impact event at the vehicle comprises segmenting the vulnerable road user from an image, identifying the vulnerable road user, and tracking the vulnerable road user to detect the impending impact event; and wherein detecting the impending impact event at the device associated with the vulnerable road user comprises receiving a signal chosen from one of an audible signal and a visual signal comprising the local user alert signal emitted by the vehicle responsive to the vehicle detecting the impending impact event, wherein for the audible signal, the signal processor is operable for distinguishing the audible signal over ambient noise, and for the visual signal, the signal processor is operable for identifying the visual signal as being associated with the impending impact event based on one or more of a pattern of one or more lights emitted from the vehicle, an intensity of the one or more lights emitted from the vehicle, and a duration of the one or more lights emitted from the vehicle, wherein the local user alert is only generated when it is determined that the user associated with the device is one of a pedestrian, cyclist, or other vulnerable road user.

14. The method of claim 13, wherein, when the impact event is detected at the vehicle, the method further comprises sending a signal from the vehicle to the device to inform the device of the impending impact event.

15. The method of claim 14, wherein the signal comprises one or more of the audible signal, a non-audible signal, and the visual signal.

16. The method of claim 13, wherein, When the impact event is detected at the device, the method further comprises sending a signal from the device to the vehicle to inform the vehicle of the impending impact event.

17. The method of claim 13, further comprising, coincident with delivering the local user alert to the vulnerable road user at the device, illuminating an illumination device coupled to the device and associated with the vulnerable road user.

18. The method of claim 13, wherein the device comprises one of microphone-equipped headphones, sensor-equipped headphones, noise-canceling headphones, a mobile phone, a smart watch, a dedicated carry-able device, a dedicated wearable device, and a pet collar.

* * * * *